United States Patent [19]

Karl et al.

[11] 4,223,518

[45] Sep. 23, 1980

[54] SUCTION AIR NOZZLE FOR FORMING A THREAD RESERVE

[75] Inventors: Rupert Karl; Edmund Schuller, both of Ingolstadt, Fed. Rep. of Germany

[73] Assignee: Schubert & Salzer, Ingolstadt, Fed. Rep. of Germany

[21] Appl. No.: 5,505

[22] Filed: Jan. 22, 1979

[30] Foreign Application Priority Data

Jan. 24, 1978 [DE] Fed. Rep. of Germany ..... 2802913

[51] Int. Cl.[3] ..... D01H 15/02

[52] U.S. Cl. ..... 57/263; 57/305; 242/35.6 E

[58] Field of Search ..... 57/58.89, 58.95, 263, 57/304, 305; 242/35.6 R, 35.6 E, 35.5 A; 226/7, 91, 92, 97

[56] References Cited

U.S. PATENT DOCUMENTS

| | | | |
|---|---|---|---|
| 3,077,312 | 2/1963 | Furst | 242/35.6 R |
| 3,131,879 | 5/1964 | Glastra et al. | 242/35.6 E |
| 3,136,494 | 6/1964 | Furst | 242/35.6 EX |
| 3,595,493 | 7/1971 | Tsukuma et al. | 242/35.6 R |
| 3,810,352 | 5/1974 | Miyazaki et al. | 57/58.95 X |
| 4,145,867 | 3/1979 | Kamp | 57/263 |

*Primary Examiner*—John Petrakes

*Attorney, Agent, or Firm*—Bailey, Dority & Flint

[57] ABSTRACT

An elongated suction air nozzle provided for forming a thread reserve in the form of a loop in thread running past the mouth thereof. A constriction is provided in the nozzle and extends for the whole length of the expected loop size. The constriction divides the cross-sectional area of the nozzle into two partial areas resulting in air flow in the central region of the nozzle being of a greater velocity than in the two partial remote areas.

6 Claims, 4 Drawing Figures

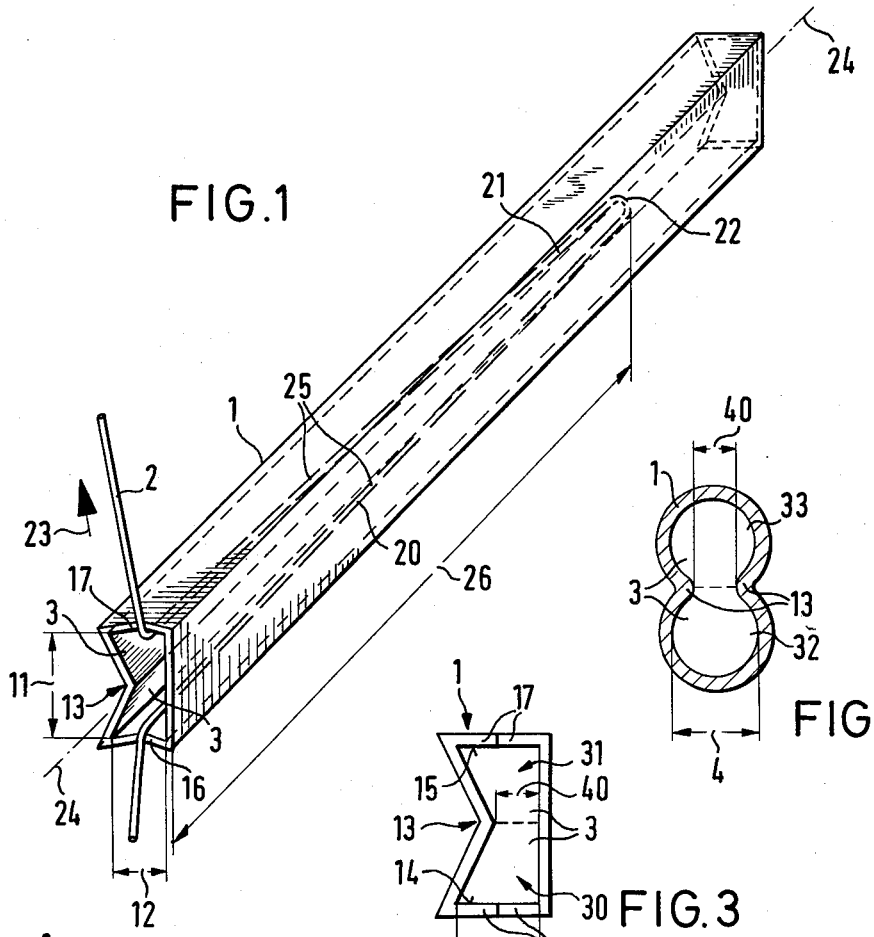
FIG.1
FIG.4
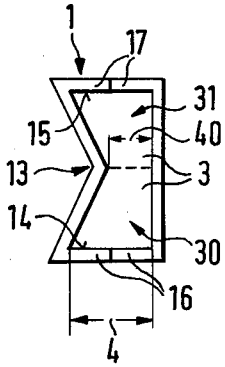
FIG.3
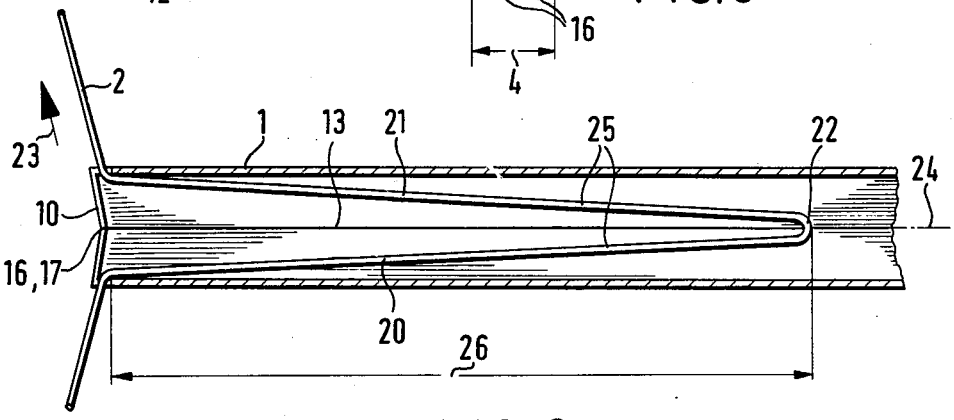
FIG.2

SUCTION AIR NOZZLE FOR FORMING A THREAD RESERVE

BACKGROUND OF THE INVENTION

The present invention relates to a suction air nozzle for forming a thread reserve, in which a passing thread undergoes intermediate storage in the form of a loop and which has an elongated cross-section of which a larger inside dimension extending in the direction of thread travel is substantially greater than a smaller inside dimension.

The method of intermediate storage of the thread with a device of this kind for thread tension equalization is known (DT-OS 1 785 321). Although, due to the suction air nozzle having an elongate cross-section, swirling of the thread is rendered difficult, it nevertheless happens that the thread forms knots which must then be separated from the thread in a separate rewinding process.

SUMMARY OF THE INVENTION

In accordance with this invention a suction air nozzle includes a constriction extending over the whole length of an expected loop size by which the cross-sectional area of the suction air nozzle, as seen in the direction of the thread travel, is divided into two partial areas. It has proved to be particularly advantageous if, measured perpendicularly to the direction of thread travel, the dimension of the suction air nozzle in the region of the constriction is essentially half as great as the maximum diameter in the region of the partial areas. Advantageously, the two partial areas are therein constructed essentially symmetrically. In order to avoid air vortices, the cross-section of the suction air nozzle is appropriately constant over the length of the constriction. In order to avoid friction to a large extent, the suction air nozzle preferably extends rectilinearly over the length of the constriction.

Advantageously, the suction air nozzle comprises a thread guide at its mouth. As a result of the constriction of the suction air nozzle two partial areas are produced with slower air flow than in the region of the intermediate constriction. Since the air flows more slowly in the region of the two partial areas, the thread here is retarded relative to the central region of the suction air nozzle, where the air flows faster, and is forced out of the central region of the two partial areas. In this way, swirling and knot formation of the thread are reliably avoided.

Accordingly, it is an important object of the present invention to provide a suction air nozzle for storage of yarn in the form of a loop wherein knotting of the yarn is avoided.

Still another important object of the present invention is to provide a relatively simple and effective nozzle storage of yarn while minimizing tangling.

These and other objects and advantages of the invention will become apparent upon reference to the following specification, attendant claims, and drawing.

BRIEF DESCRIPTION OF THE DRAWING

FIG. 1 is a perspective view illustrating an air suction nozzle constructed in accordance with the present invention, FIG. 2 is a partial side elevational view of the nozzle, FIG. 3 is a front view of the nozzle illustrated in FIGS. 1 and 2, and FIG. 4 is a cross-sectional view of a modified form of the nozzle constructed in accordance with the present invention.

DESCRIPTION OF A PREFERRED EMBODIMENT

In open-end spinning machines, it can happen due to operation-dependent time differentials on switching on the various working members that a thread surplus must undergo intermediate storage, then subsequently be discharged again gradually. This may be the case for example when starting spinning, when due to the mass inertia of the full bobbins these can be brought to their operating speed only after a time lag. This may however, also be the case when knotting, when during the knotting process the thread 2 must not be moved, so that with continuous winding and likewise continuous supply a thread reserve located behind the knotting device is used up and another thread reserve located in front of the knotting device is built up. Even when winding has not yet begun up until completion of the knotting process, the thread must be stopped in the knotting device with effective supply, for which purpose during the knotting process in front of the knotting device a thread reserve must be built up, which is to be discharged after completion of the knotting process and after the beginning of winding.

In all cases of application, the thread 2 undergoing intermediate storage should be free from flaws. In order to avoid formation of knots in the thread undergoing intermediate storage, the suction air nozzle 1 (FIGS. 1 and 2) is constructed according to the invention in such a way that the two thread sections 20 and 21 between the mouth 10 of the suction air nozzle 1 and the end 22 of the thread loop 25 are prevented from being able to become entangled with each other. The thread loop 25 is thus prevented from being able to rotate about its longitudinal axis 24 due to the existing curl tension, whereby the thread sections 20 and 21 could cross over and hence become entangled with each other. For this purpose, the suction air nozzle 1 has an elongate cross-section of which the larger inside dimension 11 extends in the direction of thread travel 23 and thereby is substantially greater than the smaller inside dimension 12. Furthermore, the suction air nozzle 1 comprises over the whole length 26 of the expected maximum size of the thread loop 25 a constriction 13 by which the cross-sectional area 3 of the suction air nozzle 1, as seen in the direction of thread travel, is divided into two partial areas 30 and 31. On account of the greater suction air velocity acting in the region of the constriction 13, the thread loop 25 is particulary accelerated in this central region, so that due to the resulting thread tension the thread sections 20 and 21 are likewise tensioned and occupy the shortest connecting line between the lower or upper edge 14 and 15 and the end 22 of the thread loop 25. Since this accelerated air flow acts in the region of the constriction 13 between the two thread sections 20 and 21, the two thread sections 20 and 21 are constantly held apart, whereby swirling, twisting and knotting of the thread 2 are effectively avoided.

It has proved to be particularly advantageous herein if the dimension 40 of the suction air nozzle 1 in the region of the constriction 13 is essentially half as great as the maximum dimension 4 of the partial areas 30 and 31, measured perpendicularly to the direction of thread travel 23.

In order to tension the thread 2 uniformly in the suction air nozzle 1, it is advantageous if the two partial areas 30 and 31 are essentially symmetrical. This insures that the two thread sections 20 and 21 are subjected to equal air currents. According to the material and yarn count however, certain variations from this may also be advantageous.

Appropriately, the cross-section over the length of the constriction 13, i.e., at least over the length 26 of the maximum expected size of the thread loop 25, is constant. With certain materials and with greater lengths 26 of the thread loop 25 however, it may also be advantageous in certain circumstances if the cross-section of the suction air nozzle 1 decreases with increasing distance from the mouth 10 to increase the air speed and hence increase thread tension. In order to avoid unnecessary friction which might impair the effect of the constriction 13, according to a further characteristic of the invention the suction air nozzle 1 extends rectilinearly over the length of its constriction 13.

Advantageously, the mouth of the suction air nozzle 1 has a thread guide which according to FIGS. 1 to 3 is constructed as a V-shaped notch 16 and 17 at the lower or upper edge 14 or 15 of the mouth 10 of the suction air nozzle 1. Of course, the thread guide if desired, may also be constructed differently, e.g., by integrated or attached guide projections. By means of the thread guide the thread 2 is maintained optimally within the main air stream at the mouth 10 of the suction air nozzle.

According to FIGS. 1 and 3, the suction air nozzle 1 comprises by way of example, a cross-section composed of two trapezia. According to FIG. 4, a modified form of the invention, the suction air nozzle 1 has a cross-section which is composed of two circular partial areas 32 and 33.

It is also of no importance whether the constriction 13 is provided on one or two sides in the suction air nozzle 1. According to FIGS. 1 and 3, the cross-section is reduced by a constriction 13 on one side, whereas according to FIG. 4, a constriction 13 on two sides is provided.

While a preferred embodiment of the invention has been described using specific terms, such description is for illustrative purposes only, and it is to be understood that changes and variations may be made without departing from the spirit or scope of the following claims.

What is claimed is:

1. An elongated suction air nozzle (1) for forming a thread reserve in the form of a loop in thread running past the mouth of said nozzle, said elongated air nozzle having an inside dimension extending in a direction of thread travel which is substantially greater than a smaller inside dimension transverse thereto producing an elongated cross-section, the improvement comprising:

a constriction (13) provided in said nozzle and extending for the whole length of the expected loop size; and said constriction (13) dividing said cross-sectional area (3) of said nozzle as seen in the direction of travel of said thread into two partial areas (30, 31; 32, 33).

2. The elongated suction nozzle as set forth in claim 1 further comprising:

the dimension (4) of the suction air nozzle (1) in the region of said constriction (13) measured perpendicularly to the direction of thread travel being essentially one-half as great as the maximum dimension (4) in the region of said partial areas (30, 31; 32, 33).

3. The elongated suction nozzle (1) as set forth in claim 1 or 2 further comprising:

said two partial areas (30, 31; 32, 33) being constructed essentially symmetrically.

4. The elongated suction nozzle as set forth in claim 1 further comprising:

said nozzle (1) having a cross-section essentially constant over the length of said constriction (13).

5. The elongated suction nozzle as set forth in claims 1 or 4 further comprising:

said suction air nozzle (1) extending rectilinearly over the length of said constriction (13).

6. The suction air nozzle as set forth in claim 1 further comprising:

a thread guide (16, 17) carried at the mouth (10) of said suction air nozzle (1).

* * * * *